US010036242B2

(12) United States Patent
Stokely et al.

(10) Patent No.: US 10,036,242 B2
(45) Date of Patent: Jul. 31, 2018

(54) DOWNHOLE ACOUSTIC DENSITY DETECTION

(71) Applicant: HALLIBURTON ENERGY SERVICES, INC., Houston, TX (US)

(72) Inventors: Christopher Lee Stokely, Houston, TX (US); Neal Gregory Skinner, Lewisville, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 230 days.

(21) Appl. No.: 14/900,752

(22) PCT Filed: Jun. 11, 2014

(86) PCT No.: PCT/US2014/041859
§ 371 (c)(1),
(2) Date: Dec. 22, 2015

(87) PCT Pub. No.: WO2015/026424
PCT Pub. Date: Feb. 26, 2015

(65) Prior Publication Data

US 2016/0138386 A1 May 19, 2016

(30) Foreign Application Priority Data

Aug. 20, 2013 (WO) ..... PCT/US2013/055713

(51) Int. Cl.
*E21B 47/10* (2012.01)
*E21B 47/14* (2006.01)
*E21B 47/06* (2012.01)

(52) U.S. Cl.
CPC ..... *E21B 47/101* (2013.01); *E21B 47/06* (2013.01); *E21B 47/14* (2013.01)

(58) Field of Classification Search
CPC ..... E21B 47/101; E21B 43/14; E21B 43/26; E21B 47/06; E21B 47/123; E21B 41/0064; E21B 47/14; G01H 5/00; G01V 8/02
See application file for complete search history.

(56) References Cited

U.S. PATENT DOCUMENTS 3,834,227 A 9/1974 Patterson et al.
4,183,243 A 1/1980 Patterson et al.
(Continued)

FOREIGN PATENT DOCUMENTS

WO 2010136773 12/2010

OTHER PUBLICATIONS

Alford et al., "Development and Field Evaluation of the Production Surveillance Monitor", Journal of Petroleum Technology, SPE 6095, Feb. 1978, 7 pages.
(Continued)

*Primary Examiner* — Yong-Suk Ro
(74) *Attorney, Agent, or Firm* — Kilpatrick Townsend & Stockton LLP

(57) ABSTRACT

Fluid densities can be monitored in real-time in a wellbore, such as during downhole stimulation operations, using an acoustic pressure-sensing system. The measured acoustic signal can be used to determine pressure fluctuations of a fluid in non-laminar flow. An estimated density of the fluid can be calculated based on the pressure fluctuations of the fluid and a known flow rate of the fluid. The flow rate of the fluid can be known, such as when being held constant by surface equipment or when measured at the surface.

20 Claims, 7 Drawing Sheets

(56) References Cited

U.S. PATENT DOCUMENTS

| | | | | |
|---|---|---|---|---|
| 4,347,747 | A | 9/1982 | Krishnaswamy | |
| 6,341,987 | B1 | 1/2002 | Chih et al. | |
| 6,354,147 | B1 | 3/2002 | Gysling et al. | |
| 6,782,150 | B2 | 8/2004 | Davis et al. | |
| 6,785,004 | B2 | 8/2004 | Kersey et al. | |
| 7,281,415 | B2 | 10/2007 | Johansen | |
| 7,401,530 | B2 | 7/2008 | Johansen | |
| 7,880,133 | B2 | 2/2011 | Johansen | |
| 7,881,884 | B2 | 2/2011 | Perry et al. | |
| 7,938,023 | B2 | 5/2011 | Johansen et al. | |
| 8,347,958 | B2 | 1/2013 | Hartog et al. | |
| 8,770,283 | B2 * | 7/2014 | Hartog | E21B 47/06 166/250.01 |
| 2001/0023614 | A1 | 9/2001 | Tubel et al. | |
| 2005/0012036 | A1 | 1/2005 | Tubel et al. | |
| 2005/0046859 | A1 | 3/2005 | Waagaard | |
| 2005/0125170 | A1 | 6/2005 | Gysling et al. | |
| 2007/0047867 | A1 | 3/2007 | Goldner | |
| 2009/0200079 | A1 | 8/2009 | Zaeper et al. | |
| 2010/0038079 | A1 | 2/2010 | Greenaway | |
| 2011/0139447 | A1 | 6/2011 | Ramos et al. | |
| 2011/0292763 | A1 | 12/2011 | Coates et al. | |
| 2012/0152024 | A1 | 6/2012 | Johansen | |
| 2012/0205103 | A1 | 8/2012 | Ravi et al. | |
| 2012/0222487 | A1 | 9/2012 | Hill et al. | |
| 2013/0021615 | A1 | 1/2013 | Duncan et al. | |
| 2013/0061688 | A1 | 3/2013 | Hayward | |
| 2013/0092371 | A1 * | 4/2013 | Hartog | E21B 47/06 166/250.01 |
| 2013/0113629 | A1 | 5/2013 | Hartog et al. | |
| 2013/0133629 | A1 | 5/2013 | Ogita | |
| 2013/0336612 | A1 | 12/2013 | Pearce | |
| 2015/0014521 | A1 | 1/2015 | Barfoot | |
| 2015/0034306 | A1 | 2/2015 | Hull et al. | |
| 2015/0135819 | A1 | 5/2015 | Petrella et al. | |
| 2016/0138389 | A1 | 5/2016 | Stokely | |

OTHER PUBLICATIONS

Bakewell et al., "Wall Pressure Correlations in Turbulent Pipe Flow", U.S. Navy Underwater Sound Laboratory Report No. 559, Aug. 1962, pp. 1-62.

Clinch, "Measurement of the Wall Pressure Field at the Surfaces of a Smooth-Walled Pipe Containing Turbulent Water Flow", Journal of Sound Vibrations, vol. 9, No. 3, 1969, pp. 398-419.

Daniels et al., "Wall Pressure Fluctuations in Turbulent Pipe Flow", Technical Report TR 86-006, retrieved from http://dtic.mil/dtic/tr/fulltext/u2/a173359.pdf, Sep. 1986, 118 pages.

De Jong , "Analysis of Pulsations and Vibrations in Fluid-Filled Pipe Systems", Doctoral Thesis, Eindhoven University of Technology, retrieved from http://alexandra.tue.nl/repository/books/423649.pdf, 1994, 170 pages.

Gysling et al., "Sonar-Based, Clamp-On Flow Meter for Gas and Liquid Applications", ISA Expo, BI0036 Rev. B., 2003, 12 pages.

Johannessen et al., "Distributed Acoustic Sensing—A New Way of Listening to Your Well/Reservoir", SPE 149602, 2012, 9 pages.

Jost et al., "A Student's Guide to and Review of Moment Tensors", Seismological Research Letters, vol. 60, No. 2, Apr.-Jun. 1989, pp. 37-57.

Kang et al., "Prediction of Wall-Pressure Fluctuation in Turbulent Flows with an Immersed Boundary Method", Journal of Computational Physics, vol. 228, 2009, pp. 6753-6772.

Keith et al., "Wavenumber-Frequency Analysis of Turbulent Wall Pressure Fluctuation over a Wide Reynolds Number Range of Turbulent Pipe Flows", Sensors and Sonar Systems Department, Naval Undersea Warfare Center, Newport, Rhode Island, Oceans 2011 Conference, Sep. 2011, 5 pages.

Kersey et al., "Fiber-Optic Systems for Reservoir Monitoring", World Oil, vol. 10, Oct. 1999, pp. 91-97.

Kragas et al., "Downhole Fiber-Optic Multiphase Flowmeter: Design, Operating Principle, and Testing", SPE Annual Technical Conference and Exhibition, San Antonio, Texas, Sep. 29-Oct. 2, 2002, pp. 1-7.

Lauchle et al., "Wall-Pressure Fluctuations in Turbulent Pipe Flow", Physics of Fluids, vol. 30, 1987, pp. 3019-3024.

Maestrello , "Measurement and Analysis of the Response Field of Turbulent Boundary Layer Excited Panels", Journal of Sound Vibrations, vol. 2, No. 3, 1965, pp. 270-292.

Patterson, "A FLowline Monitor for Production Surveillance", SPE 5769, 1976, 8 pages.

International Patent Application No. PCT/US2014/041859, International Search Report and Written Opinion, dated Oct. 6, 2014, 17 pages.

Unalmis et al., "Evolution in Optical Downhole Multiphase Flow Measurement: Experience Translates into Enhanced Design", SPE 126741, 2010, 17 pages.

* cited by examiner

DOWNHOLE ACOUSTIC DENSITY DETECTION

CROSS-REFERENCE TO RELATED APPLICATIONS

This is a U.S. national phase under 35 U.S.C. § 371 of International Patent Application No. PCT/US2014/041859, titled "DOWNHOLE ACOUSTIC DENSITY DETECTION" and filed Jun. 11, 2014, which claims the benefit of PCT Application No. PCT/US2013/055713, titled "SUBSURFACE FIBER OPTIC STIMULATION-FLOW METER" filed Aug. 20, 2013, the entirety of each of which is incorporated herein by reference.

TECHNICAL FIELD

The present disclosure relates to downhole sensing generally and more specifically to downhole sensing of material densities.

BACKGROUND

Hydrocarbons can be produced from wellbores drilled from the surface through a variety of producing and non-producing formations. The formation can be fractured, or otherwise stimulated, to facilitate hydrocarbon production. A stimulation operation often involves high flow rates and the presence of a proppant.

Monitoring the density of the stimulation fluid, which can include the proppant, can be challenging. A radioactive densometer can be used around a tubular, which involves placing a radioactive source across from a radiation detector around a tubular and measuring the radioactive count through the tubular and the stimulation fluid. The radioactive count is inversely proportional to the density of the fluid. A radioactive source can be dangerous and expensive and can require the use of special equipment and personnel for transport and usage. The use of radioactive sources increases the dangers, equipment costs, and personnel costs involved in measuring the density of the fluid.

Outside the well, the density of a fluid can be measured using a Coriolis meter. The Coriolis meter requires relatively low pressure and cannot be implemented within the wellbore.

Quantitatively monitoring fluid density in a downhole wellbore environment can be particularly challenging.

BRIEF DESCRIPTION OF THE DRAWINGS

The specification makes reference to the following appended figures, in which use of like reference numerals in different figures is intended to illustrate like or analogous components

DETAILED DESCRIPTION

Figure 1:
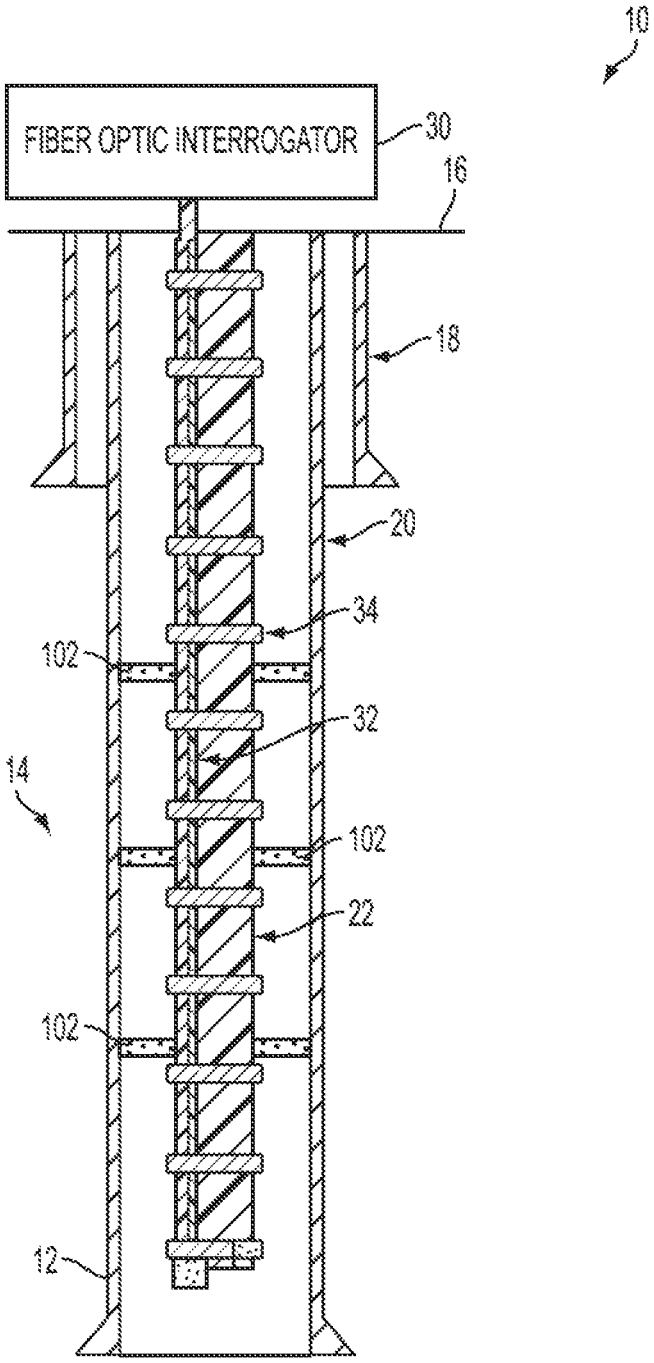
FIG. 1 is a cross-sectional schematic view of a wellbore including a fiber optic acoustic sensing subsystem according to one embodiment.

Certain aspects and features relate to monitoring fluid densities in a wellbore, such as during downhole stimulation operations, using an acoustic pressure-sensing system, such as a fiber optic acoustic sensing system. As used herein, the term "fluid" includes fluids with or without solids (e.g., proppants such as sand grains, resin-coated sand, ceramic materials, or others) included therein. The measured acoustic signal can be used to determine pressure fluctuations of the fluid when the fluid is in non-laminar flow (e.g., turbulent flow or transitional flow). An estimated density of the fluid can be calculated based on the pressure fluctuations of the fluid and a known flow rate of the fluid. The flow rate of the fluid can be known, such as when being held constant by surface equipment or when measured at the surface.

It can be desirable to track the density of the fluid in the wellbore for a number of reasons, including to ensure the density does not become so low that formation pressure overcomes the hydrostatic head of the stimulation fluid causing a blowout, and to ensure the density does not become so high that the formation is accidentally fractured by the stimulation fluid, or that the stimulation fluid leaks excessively into the formation causing a blowout due to fluid entering the formation and lowering the hydrostatic head of the stimulation fluid.

Acoustics can be relevant for monitoring or measuring fluid density. Acoustic monitoring locations can be at a few discreet locations, or distributed at locations along a fiber optic cable. Fiber Bragg gratings may commonly be used as point sensors that can be multiplexed and can allow for acoustic detection at several locations on the fiber optic cable. Often, the number of locations with fiber Bragg gratings is limited to perhaps a few dozen locations. Another fiber optic acoustic sensing method is distributed acoustic sensing, which does not require specialty fiber laser etched to produce Bragg gratings. Fiber optic distributed acoustic sensors (DAS) use traditional telecommunications fibers and allow, for example, a distributed measurement of local acoustics anywhere along the fiber. In some DAS systems, acoustic sensing may take place at every meter along a fiber optic cable in the wellbore, which may result in thousands of acoustical measurement locations. In other aspects, the distributed acoustic sensing system can include a fiber optic cable that continuously measures acoustical energy along spatially separated portions of the fiber optic cable. In some embodiments, the acoustic sensors can be electronic sensors, such as piezoelectric sensors, piezoresistive sensors, electromagnetic sensors, or others. In some embodiments, an acoustic sensor includes an array of individual sensors.

The dynamic pressure of flow in a pipe can result in small pressure fluctuations related to the dynamic pressure that can be monitored using the fiber optic acoustic sensing system. These fluctuations may occur at frequencies audible to the human ear. The dynamic pressure may be many orders of magnitude less than the static pressure. The dynamic pressure is related to fluid velocity in a pipe through the relation, $\Delta p \propto \rho \cdot \bar{u}^2$, where ρ is fluid density, and $\bar{u}$ is the average fluid flow velocity. The dynamic pressure Δp can be estimated by measuring pressure fluctuations or acoustic vibrations. The mean of Δp can be zero, while the root-mean-square of the pressure fluctuations may not be zero. If the flow rate is known, such as if the flow rate is measured while entering the wellbore or controlled through surface equipment, density of the fluid can be estimated as $\rho = K \cdot y_{RMS}/u^2$, where K is a proportionality constant, u is the known flow rate, ρ is the density of the fluid, and $y_{RMS}$ is the root-mean-square of the measured acoustic signal.

Since the flow rate of the fluid forced downhole is known during stimulation operations, the fluid density at locations in the wellbore can be measured using acoustic sensing with fiber optic cables deployed along the well at different angular locations on the pipe. The proportionality constant K can be dependent on the type of fluid and mechanical features of the well, which can be determined through a calibration procedure. Mechanical coupling of the two fiber optic sections to the pipe may be identical or characterized through a calibration procedure that can also resolve mechanical characteristics of the pipe, such as bulk modulus and ability to vibrate in the surrounding formation or cement.

Fiber optic acoustic sensing system according to some aspects can be used to monitor fluid densities at particular zones or perforations. Monitoring fluid densities at particular zones or perforations can allow operators to intelligently optimize well completions and remedy well construction issues.

In an example, during stimulation procedures, a stimulation fluid can be injected into a wellbore. Initially, the stimulation fluid can contain little or no proppant and can thus have a low density. At certain times, additional proppant can be added to the stimulation fluid while the flow rate of the stimulation fluid is held constant. Further proppant can be added at subsequent times. With each addition of proppant, the density of the stimulation fluid increases. Actual density of the stimulation fluid can be measured downwell, as described herein.

These illustrative examples are given to introduce the reader to the general subject matter discussed here and are not intended to limit the scope of the disclosed concepts. The following sections describe various additional features and examples with reference to the drawings in which like numerals indicate like elements, and directional descriptions are used to describe the illustrative embodiments but, like the illustrative embodiments, should not be used to limit the present disclosure. The elements included in the illustrations herein may be not drawn to scale.

FIG. 1 depicts an example of a wellbore system 10 that includes a fiber optic acoustic sensing subsystem according to one embodiment. The system 10 can include a wellbore 12 that penetrates a subterranean formation 14 for the purpose of recovering hydrocarbons, storing hydrocarbons, disposing of carbon dioxide (which may be referred to as carbon dioxide sequestration), or the like. The wellbore 12 may be drilled into the subterranean formation 14 using any suitable drilling technique. While shown as extending vertically from the surface 16 in FIG. 1, in other examples the wellbore 12 may be deviated, horizontal, or curved over at least some portions of the wellbore 12. The wellbore 12 can include a surface casing 18, a production casing 20, and tubing 22. The wellbore 12 may be, also or alternatively, open hole and may include a hole in the ground having a variety of shapes or geometries.

The tubing 22 can extend from the surface 16 in an inner area defined by production casing 20. The tubing 22 may be production tubing through which hydrocarbons or other fluid can enter and be produced. In other aspects, the tubing 22 is another type of tubing. The tubing 22 may be part of a subsea system that transfers fluid or otherwise from an ocean surface platform to the wellhead on the sea floor.

Some items that may be included in the wellbore system 10 have been omitted for simplification. For example, the wellbore system 10 may include a servicing rig, such as a drilling rig, a completion rig, a workover rig, other mast structure, or a combination of these. In some aspects, the servicing rig may include a derrick with a rig floor. Piers extending downwards to a seabed in some implementations may support the servicing rig. Alternatively, the servicing rig may be supported by columns sitting on hulls or pontoons (or both) that are ballasted below the water surface, which may be referred to as a semi-submersible platform or rig. In an off-shore location, a casing may extend from the servicing rig to exclude sea water and contain drilling fluid returns. There may also be a wellhead present on top of the well at the surface. Other mechanical mechanisms that are not shown may control the run-in and withdrawal of a workstring in the wellbore 12. Examples of these other mechanical mechanisms include a draw works coupled to a hoisting apparatus, a slickline unit or a wireline unit including a winching apparatus, another servicing vehicle, and a coiled tubing unit.

The wellbore system 10 includes a fiber optic acoustic sensing subsystem that can detect acoustics or other vibrations in the wellbore 12, such as during a stimulation operation. The fiber optic acoustic sensing subsystem includes a fiber optic interrogator 30 and one or more fiber optic cables 32, which can be or include sensors located at different zones of the wellbore 12 that are defined by packers 102. The fiber optic cables 32 can contain single mode optical fibers, multi-mode optical fibers, or multiple fibers of multiple fiber types. The fiber optic cables 32 can each contain one or more single mode fibers, one or more multi-mode fibers, or a combination thereof. The fiber optic cables 32 can be coupled to the tubing 22 by couplers 34 (e.g., clamps). In some aspects, the couplers 34 are cross-coupling protectors located at every other joint of the tubing 22. The fiber optic cables 32 can be communicatively coupled to the fiber optic interrogator 30 that is at the surface 16.

The fiber optic interrogator 30 can output a light signal to the fiber optic cables 32. Part of the light signal can be reflected back to the fiber optic interrogator 30. The interrogator can perform interferometry and other analysis using the light signal and the reflected light signal to determine how the light is changed as it travels along the cables or interacts with sensors in the cables, which can reflect sensor changes that are measurements of the acoustics in the wellbore 12.

Fiber optic cables according to various aspects can be located in other parts of a wellbore. For example, a fiber optic cable can be located on a retrievable wireline or external to a production casing.

Figure 2:
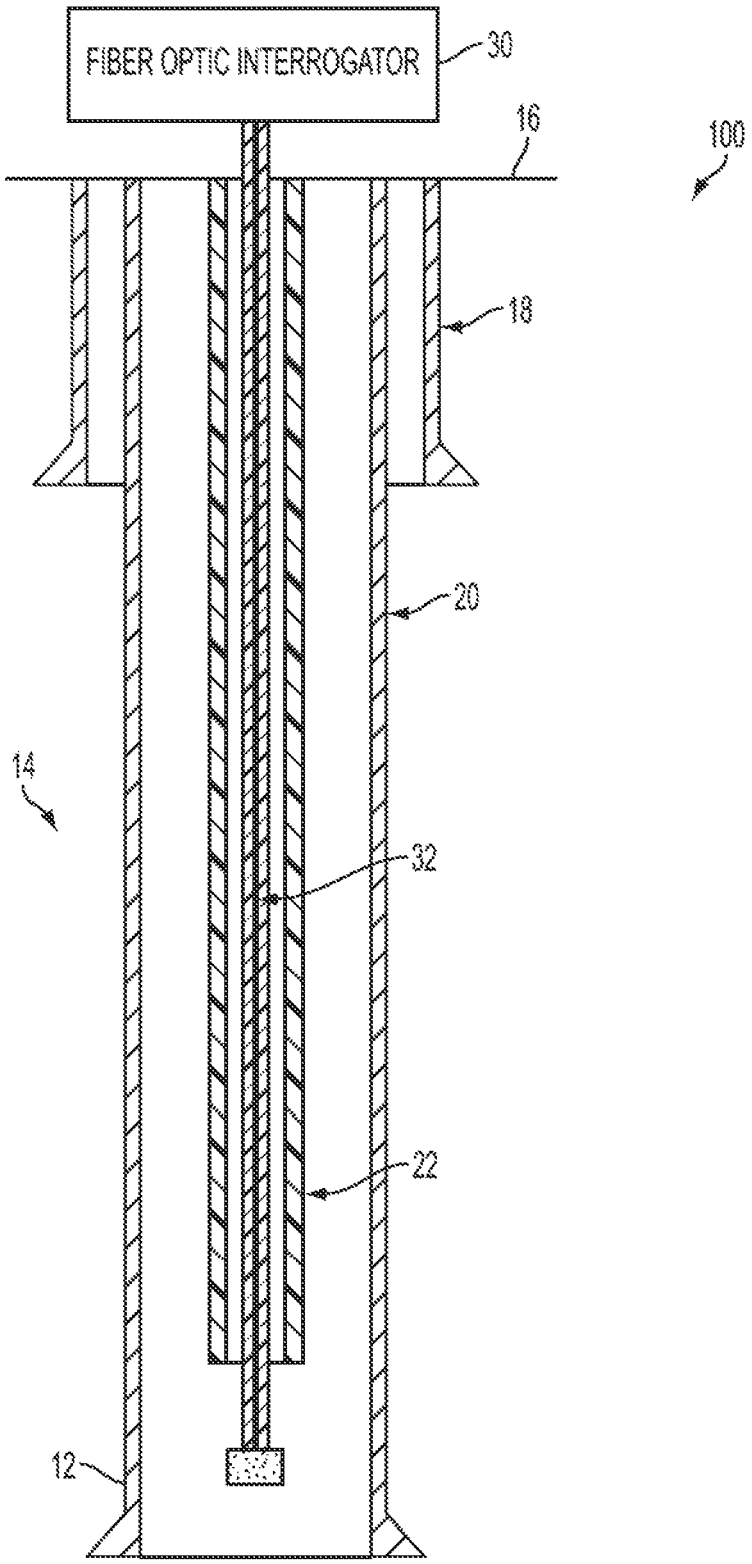
FIG. 2 is a cross-sectional schematic view of a wellbore including a fiber optic acoustic sensing subsystem according to another embodiment.

FIG. 2 depicts a wellbore system 100 that is similar to the wellbore system 10 in FIG. 1 according to one embodiment. It includes the wellbore 12 through the subterranean formation 14. Extending from the surface 16 of the wellbore 12 is the surface casing 18, the production casing 20, and tubing 22 in an inner area defined by the production casing 20. The wellbore system 100 includes a fiber optic acoustic sensing subsystem. The fiber optic acoustic sensing subsystem includes the fiber optic interrogator 30 and the fiber optic cables 32. The fiber optic cables 32 are on a retrievable wireline located within the tubing 22. Fiber optic cables 32 can be located on other structures or be free within the tubing 22.

Figure 3:
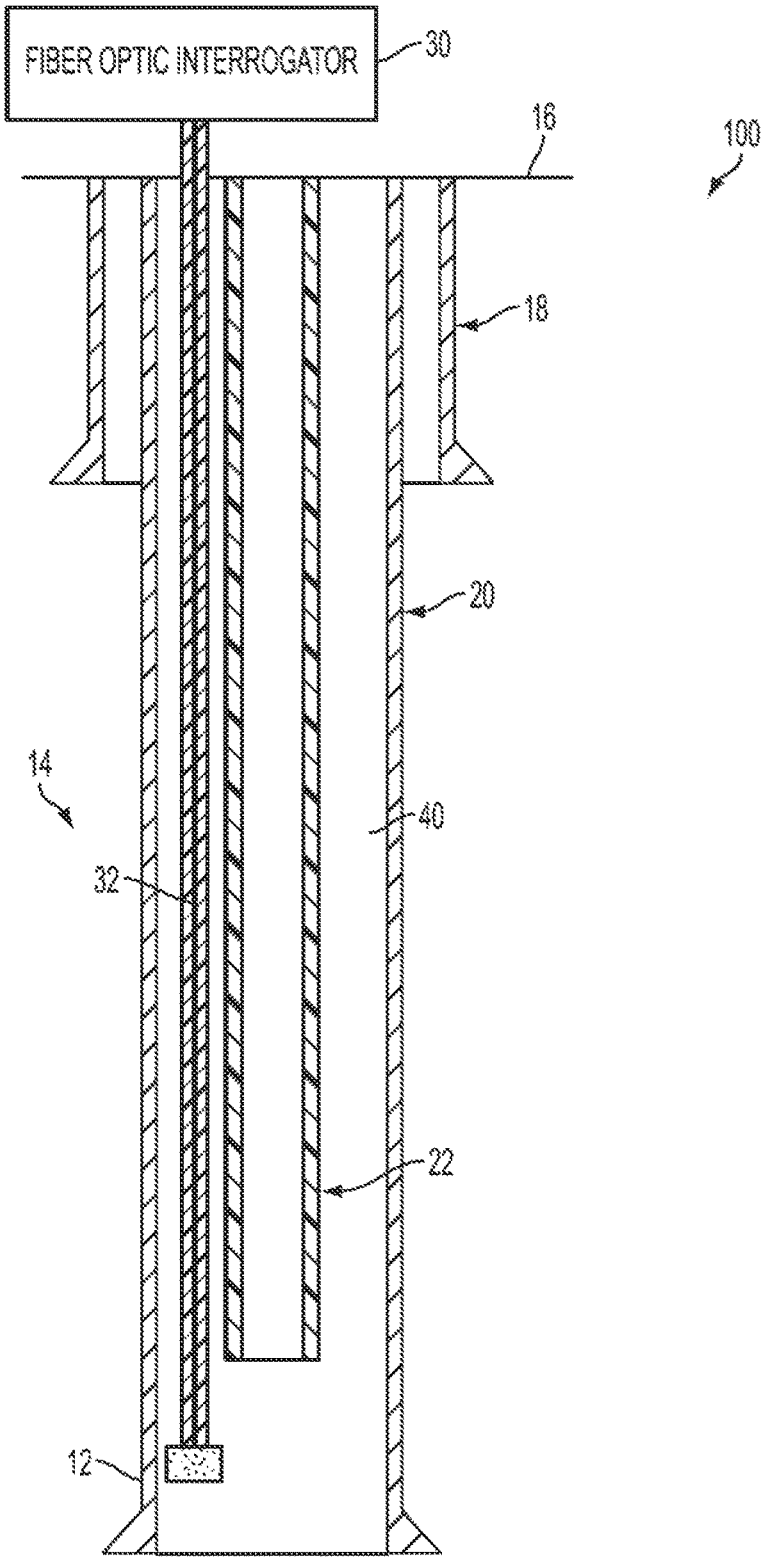
FIG. 3 is a cross-sectional schematic view of a wellbore including a fiber optic acoustic sensing subsystem according to another embodiment.

FIG. 3 depicts a wellbore system 100 that is similar to the wellbore system 10 in FIG. 2 according to one embodiment. It includes the wellbore 12 through the subterranean formation 14. Extending from the surface 16 of the wellbore 12 is the surface casing 18, the production casing 20, and tubing 22 in an inner area defined by the production casing 20. The wellbore system 100 includes a fiber optic acoustic sensing subsystem. The fiber optic acoustic sensing subsystem includes the fiber optic interrogator 30 and the fiber optic cables 32. The fiber optic cables 32 are on a retrievable wireline located within the annular space 40 between the tubing 22 and the production casing 20. Fiber optic cables 32 can be located on other structures or be free within the annular space 40.

Figure 4:
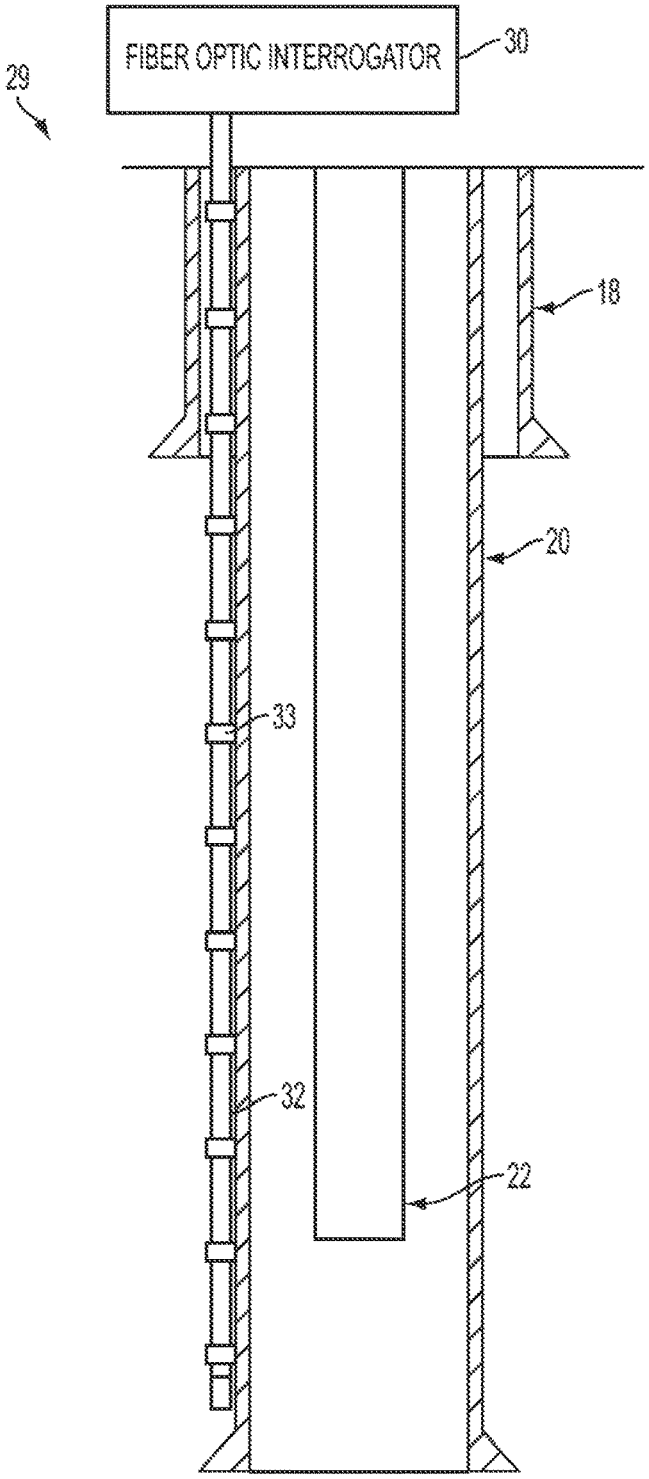
FIG. 4 is a cross-sectional schematic view of a wellbore including a fiber optic acoustic sensing subsystem according to another embodiment.

FIG. 4 depicts an example of a wellbore system 29 that includes a surface casing 18, production casing 20, and tubing 22 extending from a surface according to one embodiment. The fiber optic acoustic sensing subsystem includes a fiber optic interrogator and the fiber optic cables 32. The fiber optic cables 32 are positioned external to the production casing 20. The fiber optic cables 32 can be coupled to the production casing 20 by couplers 33.

Figure 5:
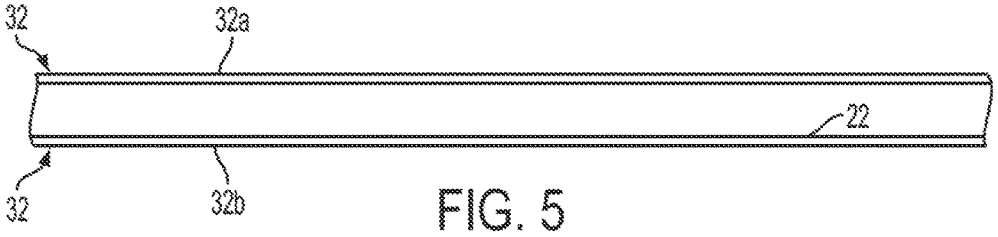
FIG. 5 is a cross-sectional side view of a two-fiber acoustic sensing system according to one embodiment.

FIG. 5 is a cross-sectional side view of an example of the tubing 22 and the fiber optic cables 32. The fiber optic cables 32 are positioned external to the tubing 22. The fiber optic cables 32 can include any number of fibers. The fiber optic cables 32 in FIG. 5 include two cables: fiber optic cable 32*a* and fiber optic cable 32*b*. The fiber optic cables 32 may perform distributed fluid density monitoring using Rayleigh backscatter distributed acoustic sensing.

Figure 6:
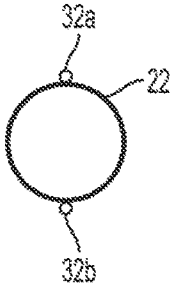
FIG. 6 is a cross-sectional view of tubing with fiber optic cables positioned at different angular positions external to the tubing according to one embodiment.
Figure 7:
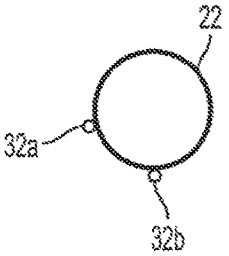
FIG. 7 is a cross-sectional view of tubing with fiber optic cables positioned at different angular positions external to the tubing according to another embodiment.

Fiber optic cable 32*a* and fiber optic cable 32*b* can be positioned at different angular positions relative to each other and external to the tubing 22. FIGS. 5 and 6 depict cross-sectional views of examples of the tubing 22 with fiber optic cables 32 positioned at different angular positions external to the tubing 22. In FIG. 6, fiber optic cable 32*a* is positioned directly opposite from fiber optic cable 32*b*. In FIG. 7, fiber optic cable 32*a* is positioned approximately eighty degrees relative to fiber optic cable 32*b*. Any amount of angular offset can be used. The angular positions of the fiber optic cables 32 may be used for common mode noise rejection. For example, a difference in acoustical signals from the fiber optic cables 32 at different angular locations on the tubing 22 can be determined. The difference may be filtered to remove high or low frequencies, such as a sixty hertz power frequency associated with the frequency of alternating current electricity used in the United States. A statistical measure of that difference signal, which can be the root mean square or standard deviation, can be performed to determine the fluid density. For example, the fluid density can be characterized based on a known flow rate of the fluid that is measured at the surface or controlled. Moreover, other aspects of the fluid related to the proportionality constant can be characterized through a calibration process since the fluid introduced into the wellbore for stimulation can be controlled.

In some embodiments, only a single fiber optic cable is used and no differential comparison, such as common mode noise rejection, is used. In such embodiments, other processing (e.g., filtering out a sixty hertz power frequency) can be used as otherwise described herein, where applicable.

Distributed sensing of fluid density at one or more downhole locations as in the figures or otherwise can be useful in monitoring flow downhole during stimulation operations. In some aspects, a fiber optic cable includes a sensor that is a stimulation fluid flow acoustic sensor. The sensor is responsive to acoustic energy in stimulation fluid in a wellbore by modifying light signals in accordance with the acoustic energy. The sensor may be multiple sensors distributed in different zones of a wellbore. The sensor may be the fiber optic cable itself, fiber Bragg gratings, coiled portions of the fiber optic cable, spooled portions of the fiber optic cable, or a combination of these. A fiber optic interrogator may be a stimulation fluid density fiber optic interrogator that is responsive to light signals modified in accordance with the acoustic energy and received from the fiber optic cable by determining fluid density of the stimulation fluid.

Figure 8:
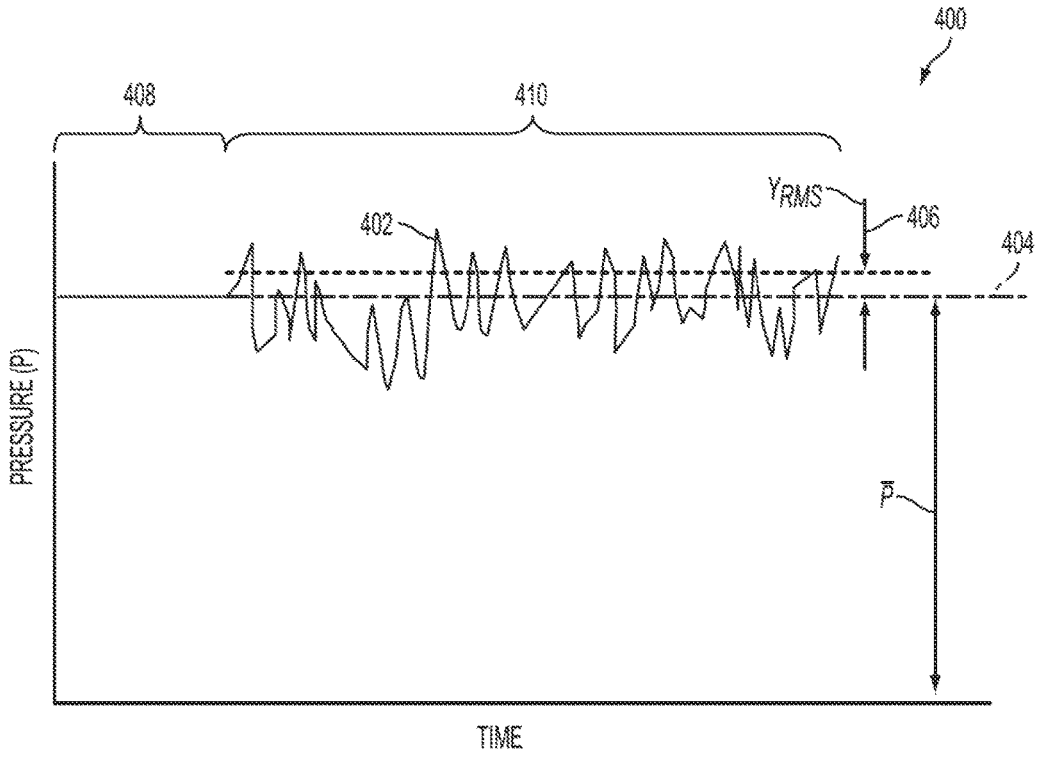
FIG. 8 is an example of a graph depicting acoustically sensed pressure fluctuations with respect to time according to one embodiment.

FIG. 8 is an example of a graph depicting acoustically sensed pressure fluctuations 402 with respect to time according to one embodiment. Sensed acoustic signals can be processed by the fiber optic interrogator 30 and translated into instantaneous pressure fluctuations. Line 402 represents the time-dependent pressure P. During laminar flow 408, the time-dependent pressure P stays constant. During non-laminar flow 410, the time-dependent pressure P will fluctuate due to eddies generated within the flowing fluid. An average pressure $\overline{P}$ can be determined, and is shown as line 404. The dynamic pressure $\Delta p$ can be determined based on $\Delta p = P - \overline{P}$. Shown at measurement 406, $y_{RMS}$ is the root-mean-square of the dynamic pressure $\Delta p$.

The value of $y_{RMS}$ is related to the flow rate and density of the turbulent fluid through the equation $\rho = K \cdot y_{RMS}/u^2$, where K is a proportionality constant, u is the known flow rate, $\rho$ is the density of the fluid. Since the flow rate u is known, the fiber optic interrogator 30 can calculate the density $\rho$ of the fluid using the above equation. The proportionality constant K can be determined during a calibration using fluids of known density.

Figure 9:
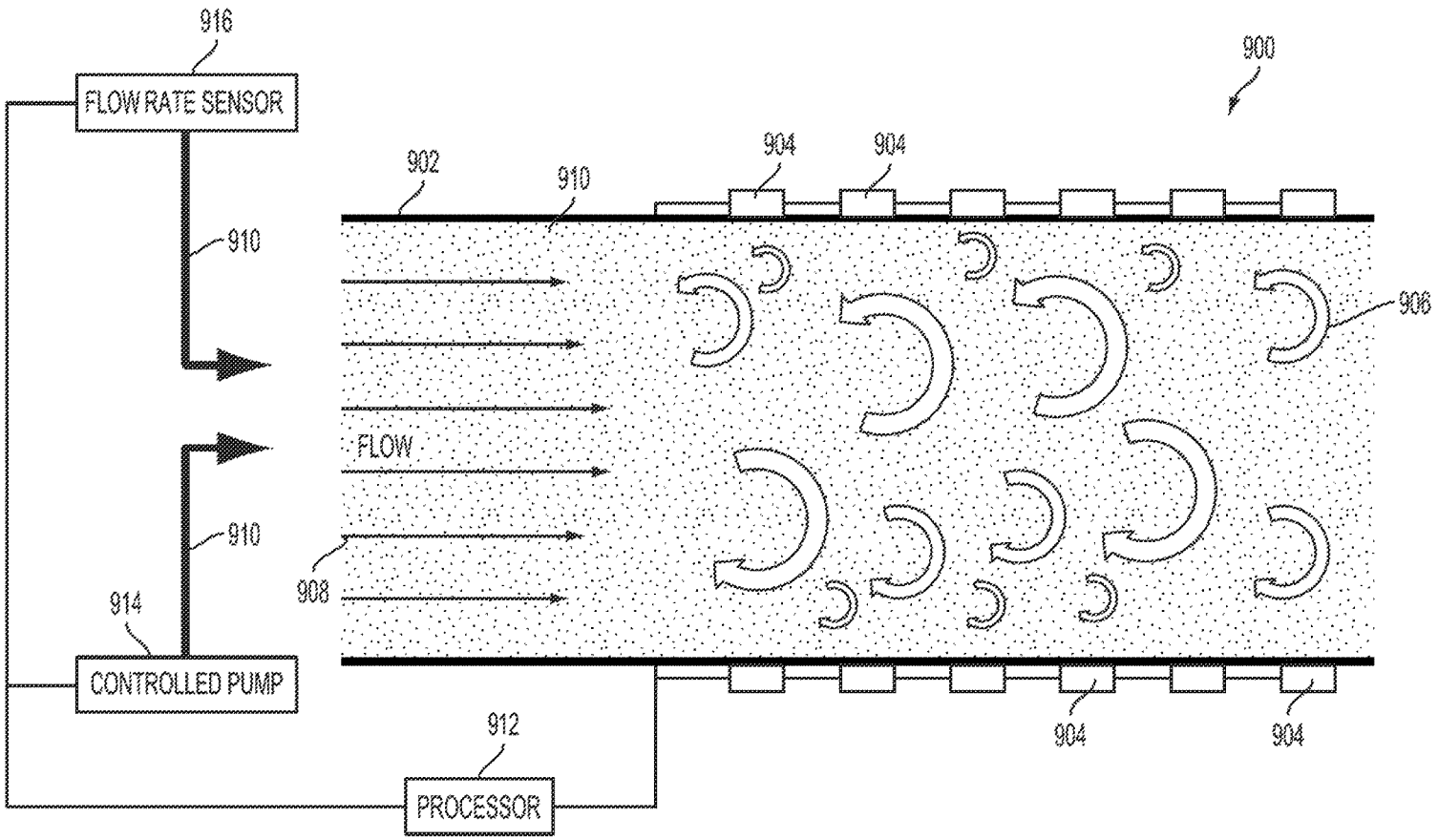
FIG. 9 is a cross-sectional side view depicting a tubing having sensors for measuring the density of a fluid according to one embodiment

FIG. 9 is a diagrammatic view depicting a tubing 902 having sensors 904 for measuring the density of a fluid 910 according to one embodiment. The fluid 910 can flow in direction 908. During non-laminar flow, such as during turbulent flow or transitional flow, eddies 906 of various sizes can occur within the tubing 902. Sensors 904 can pick up acoustic waves caused by the eddies 906. Sensors 904 can be optical sensors as described above, or any other type of acoustic or pressure sensor.

In some embodiments, the sensors 904 can be operably connected to a processor 912. The processor 912 can be included in the fiber optic interrogator 30 or can be one or more separate processors. The processor 912 can perform the calculations and analysis described herein.

In some embodiments, the fluid 910 can be supplied to the tubing 902 through a controlled pump 914 that outputs the fluid 910 at a known flow rate. In some embodiments, the fluid 910 can be supplied to the tubing 910 after passing through a flow rate sensor 916 that determines the flow rate of the fluid 910 at the surface. The flow rate sensor 916 and/or controlled pump 914 can be operatively coupled to the processor 912 to provide the processor 912 with a flow rate of the fluid 910. As used herein, the terms controlled pump 914 and flow rate sensor 916 are inclusive of any electronics specifically necessary to operate the controlled pump 914 and flow rate sensor 916, respectively.

In some embodiments, the fluid 910 can be a production fluid containing a mixture of oil, gas, and water. By determining the density of the fluid 910 flowing through the tubing 22, one can infer the ratio of the major components of the production fluid downwell. In some cases, a problem with the well can be noticed early by detecting an unexpected change in the fluid density, such as a change that correlates with a large ingress of water. Problems can be localized to a particular zone or area of a well because the location of the sensor, whether fiber optic or otherwise, is known. Any zones that produce large quantities of water can be detected and selectively shut off.

In some embodiments, the calculated fluid density of the fluid 910 at one location (e.g., a first zone) and another location (e.g., a second zone) can be compared to determine a status of the well, including whether there are any problems with the well.

In some embodiments, the fluid 910 can be cement, hydraulic fracturing fluid, drilling mud, or other fluids. In some embodiments, the density of drilling mud can be monitored downwell in real-time.

All patents, publications and abstracts cited above are incorporated herein by reference in their entirety. Various embodiments have been described. It should be recognized that these embodiments are merely illustrative of the principles of the present disclosure. Numerous modifications and adaptations thereof will be readily apparent to those skilled in the art without departing from the spirit and scope of the present disclosure as defined in the following claims.

The foregoing description of the embodiments, including illustrated embodiments, has been presented only for the purpose of illustration and description and is not intended to be exhaustive or limiting to the precise forms disclosed. Numerous modifications, adaptations, and uses thereof will be apparent to those skilled in the art.

As used below, any reference to a series of examples is to be understood as a reference to each of those examples disjunctively (e.g., "Examples 1-4" is to be understood as "Examples 1, 2, 3, or 4").

Example 1 is a system including an acoustic sensor positionable in a wellbore for measuring pressure fluctuations of a fluid in non-laminar flow. The system includes a processor couplable to the acoustic sensor and responsive to signals received from the acoustic sensor for calculating a fluid density of the fluid based on the measured pressure fluctuations and a flow rate of the fluid.

Example 2 is the system of example 1 where the acoustic sensor includes an array of sensors.

Example 3 is the system of examples 1-2 where the acoustic sensor includes a distributed acoustic sensor.

Example 4 is the system of example 3, further comprising a fiber optic interrogator, wherein the distributed acoustic sensor includes a fiber optic cable couplable to the fiber optic interrogator and the fiber optic interrogator includes the processor.

Example 5 is the system of examples 1-4, further comprising a flow rate sensor positionable in fluid communication with the fluid and couplable to the processor for providing the flow rate of the fluid to the processor, wherein the processor is operable to calculate the fluid density of the fluid based on the measured pressure fluctuations and the flow rate of the fluid.

Example 6 is the system of examples 1-5, further comprising a controlled pump positionable in fluid communication with the fluid and couplable to the processor for providing the flow rate of the fluid to the processor, wherein the processor is operable to calculate the fluid density of the fluid based on the measured pressure fluctuations and the flow rate of the fluid.

Example 7 is the system of examples 1-6, further comprising a second acoustic sensor positionable in the wellbore at a second location spaced apart from a first location of the acoustic sensor, the second acoustic sensor operable to measure additional pressure fluctuations of the fluid, wherein the processor is operable to calculate an additional fluid density of the fluid based on the measured additional pressure fluctuations and the flow rate of the fluid.

Example 8 is a method including acoustically measuring pressure fluctuations of a fluid in non-laminar flow in a wellbore by an acoustic sensor. The method also includes calculating, by a processor, a fluid density of the fluid based on the measured pressure fluctuations and a flow rate of the fluid.

Example 9 is the method of example 8 where acoustically measuring pressure fluctuations of the fluid by the acoustic sensor includes sensing pressure fluctuations by an array of electronic sensors positioned in the wellbore, wherein the acoustic sensor includes the array of electronic sensors.

Example 10 is the method of examples 8-9 where acoustically measuring pressure fluctuations of the fluid by the acoustic sensor includes sensing pressure fluctuations by a fiber optic cable, wherein the acoustic sensor includes the fiber optic cable.

Example 11 is the method of examples 8-10, further comprising performing a calibration using a known fluid having a known density.

Example 12 is the method of examples 8-11, further comprising measuring the flow rate of the fluid by a flow rate sensor.

Example 13 is the method of examples 8-12, further comprising pumping the fluid into the wellbore at the flow rate.

Example 14 is the method of examples 8-12, further comprising acoustically measuring additional pressure fluctuations of the fluid at a second location in the wellbore, wherein acoustically measuring the pressure fluctuations occurs at a first location in the wellbore; and calculating, by the processor, an additional fluid density based on the measured additional pressure fluctuations and the flow rate of the fluid.

Example 15 is the method of example 14, further comprising comparing the fluid density and the additional fluid density to determine a well status.

Example 16 is a system including a fiber optic cable positionable in a wellbore for receiving acoustic signals from a fluid in non-laminar flow and a fiber optic interrogator optically coupled to the fiber optic cable for determining pressure fluctuations based on the acoustic signals received by the fiber optic cable, the fiber optic interrogator operable to receive a flow rate of the fluid and calculate a fluid density based on the pressure fluctuations and the flow rate.

Example 17 is the system of example 16, further comprising a flow rate sensor in fluid communication with the wellbore and operable to measure the flow rate of the fluid in the wellbore, wherein the flow rate sensor is coupled to the fiber optic interrogator to provide the flow rate to the fiber optic interrogator.

Example 18 is the system of examples 16-17, further comprising a controlled pump in fluid communication with the wellbore and operable to pump the fluid into the wellbore at the flow rate, wherein the controlled pump is coupled to the fiber optic interrogator to provide the flow rate to the fiber optic interrogator.

Example 19 is the system of examples 16-18 where the fiber optic cable is coupled to a tubing and the fluid flows within the tubing.

Example 20 is the system of examples 16-18, further comprising a wireline removably positionable in the wellbore, wherein the wireline includes the fiber optic cable.

What is claimed is:

1. A system, comprising:

an acoustic sensor positionable in a wellbore for measuring pressure fluctuations of a stimulation or production fluid in non-laminar flow past the acoustic sensor; and a processor couplable to the acoustic sensor and responsive to signals received from the acoustic sensor for calculating a fluid density of the stimulation or production fluid based on the measured pressure fluctuations, the fluid density being calculated as proportional to a root mean square of a measured signal from the acoustic sensor divided by a square of a flow rate of the stimulation or production fluid.

2. The system of claim 1, wherein the acoustic sensor includes an array of sensors.

3. The system of claim 1, wherein the acoustic sensor includes a distributed acoustic sensor.

4. The system of claim 3, further comprising a fiber optic interrogator, wherein the distributed acoustic sensor includes a fiber optic cable couplable to the fiber optic interrogator and the fiber optic interrogator includes the processor.

5. The system of claim 1, further comprising a flow rate sensor positionable in fluid communication with the stimulation or production fluid and couplable to the processor for providing the flow rate of the stimulation or production fluid to the processor, wherein the processor is operable to calculate the fluid density of the stimulation or production fluid based on the measured pressure fluctuations and the flow rate of the stimulation or production fluid.

6. The system of claim 1, further comprising a controlled pump positionable in fluid communication with the fluid and couplable to the processor for providing the flow rate of the stimulation or production fluid to the processor, wherein the processor is operable to calculate the fluid density of the stimulation or production fluid based on the measured pressure fluctuations and the flow rate of the stimulation or production fluid.

7. The system of claim 1, further comprising a second acoustic sensor positionable in the wellbore at a second location spaced apart from a first location of the acoustic sensor, the second acoustic sensor operable to measure additional pressure fluctuations of the stimulation or production fluid, wherein the processor is operable to calculate an additional fluid density of the stimulation or production fluid based on the measured additional pressure fluctuations and the flow rate of the stimulation or production fluid.

8. A method, comprising:

acoustically measuring pressure fluctuations of a stimulation or production fluid in non-laminar flow past an acoustic sensor in a wellbore; and calculating, by a processor, a fluid density of the stimulation or production fluid based on the measured pressure fluctuations, the fluid density being calculated as proportional to a root mean square of a measured signal from the acoustic sensor divided by a square of a flow rate of the stimulation or production fluid.

9. The method of claim 8, wherein acoustically measuring pressure fluctuations of the stimulation or production fluid by the acoustic sensor includes sensing pressure fluctuations by an array of electronic sensors positioned in the wellbore, wherein the acoustic sensor includes the array of electronic sensors.

10. The method of claim 8, wherein acoustically measuring pressure fluctuations of the stimulation or production fluid by the acoustic sensor includes sensing pressure fluctuations by a fiber optic cable, wherein the acoustic sensor includes the fiber optic cable.

11. The method of claim 8, further comprising performing a calibration using a known fluid having a known density.

12. The method of claim 8, further comprising measuring the flow rate of the stimulation or production fluid by a flow rate sensor.

13. The method of claim 8, further comprising pumping the stimulation or production fluid into the wellbore at the flow rate.

14. The method of claim 8, further comprising:

acoustically measuring additional pressure fluctuations of the stimulation or production fluid at a second location in the wellbore, wherein acoustically measuring the pressure fluctuations occurs at a first location in the wellbore; and calculating, by the processor, an additional fluid density based on the measured additional pressure fluctuations and the flow rate of the stimulation or production fluid.

15. The method of claim 14, further comprising:

comparing the fluid density and the additional fluid density to determine a well status.

16. A system, comprising:

a fiber optic cable positionable in a wellbore for receiving acoustic signals from a stimulation or production fluid in non-laminar flow past the fiber optic cable; and a fiber optic interrogator optically coupled to the fiber optic cable for determining pressure fluctuations based on the acoustic signals received by the fiber optic cable, the fiber optic interrogator operable to receive a flow rate of the stimulation or production fluid and calculate a fluid density based on the pressure fluctuations, the fluid density being calculated as proportional to a root mean square of a measured signal from the fiber optic cable divided by a square of the flow rate of the stimulation or production fluid and the flow rate.

17. The system of claim 16, further comprising a flow rate sensor in fluid communication with the wellbore and operable to measure the flow rate of the stimulation or production fluid in the wellbore, wherein the flow rate sensor is coupled to the fiber optic interrogator to provide the flow rate to the fiber optic interrogator.

18. The system of claim 16, further comprising a controlled pump in fluid communication with the wellbore and operable to pump the stimulation or production fluid into the wellbore at the flow rate, wherein the controlled pump is coupled to the fiber optic interrogator to provide the flow rate to the fiber optic interrogator.

19. The system of claim 16, wherein the fiber optic cable is coupled to a tubing and the stimulation or production fluid flows within the tubing.

20. The system of claim 16, further comprising a wireline removably positionable in the wellbore, wherein the wireline includes the fiber optic cable.

* * * * *